US005770828A

United States Patent [19]

Niemeyer

[11] Patent Number: 5,770,828

[45] Date of Patent: Jun. 23, 1998

[54] POWER CIRCUIT-BREAKER

[75] Inventor: Lutz Niemeyer, Birr, Switzerland

[73] Assignee: ABB Research Ltd., Zurich, Switzerland

[21] Appl. No.: 649,178

[22] Filed: May 17, 1996

[30] Foreign Application Priority Data

Jul. 3, 1995 [DE] Germany ..... 195 24 217.3

[51] Int. Cl.[6] ..... H01H 33/12

[52] U.S. Cl. ..... 218/48; 218/146

[58] Field of Search ..... 218/43, 46, 48–50, 218/53, 54, 56, 57, 59–65, 68, 72, 73, 74, 146, 76, 156

[56] References Cited

U.S. PATENT DOCUMENTS

| | | | |
|---|---|---|---|
| 2,365,133 | 12/1944 | Amer et al. | 200/148 |
| 2,636,961 | 4/1953 | Schneider | 200/148 |
| 3,264,439 | 8/1966 | Ernsting | 200/148 |
| 4,205,209 | 5/1980 | Thuries et al. | 200/163 |
| 4,253,002 | 2/1981 | Kii | 200/148 R |
| 4,511,775 | 4/1985 | Korner et la. | 200/148 A |

FOREIGN PATENT DOCUMENTS

| | | | |
|---|---|---|---|
| 0270985 | 6/1988 | European Pat. Off. | H01H 33/98 |
| 0456025A1 | 11/1991 | European Pat. Off. | H01H 33/90 |
| 1490475 | 6/1970 | Germany | H01H 33/82 |
| 1807296 | 12/1971 | Germany | H01H 1/38 |
| 2812945C2 | 5/1984 | Germany | H01H 33/985 |
| 3344094A1 | 6/1985 | Germany | H01H 33/88 |
| 2445185C2 | 10/1985 | Germany | H01H 33/985 |
| 2633093C2 | 4/1987 | Germany | H01H 33/985 |
| 2858054C3 | 11/1987 | Germany | H01H 33/85 |
| 2179796 | 3/1987 | United Kingdom | H01H 1/00 |

*Primary Examiner*—Cassandra C. Spyrou
*Assistant Examiner*—Michael A. Friedhofer
*Attorney, Agent, or Firm*—Burns, Doane, Swecker & Mathis

[57] ABSTRACT

The circuit-breaker has a quenching chamber which is filled with an insulating medium, is of cylindrical design and has a quenching zone extending along a longitudinal axis. In addition, it has a fixed contact arrangement, which is arranged in the course of a main current path, and a moving contact arrangement. Furthermore, a blowing volume is provided which stores the increased pressure of the insulating medium which occurs during a disconnection process. At least one contact link, which has two contact points, electrically conductively connects the fixed contact arrangement and the moving contact arrangement to one another in the connected position. The contact link is also mounted to a holder such that it can rotate. The side of the contact link which interacts with the fixed contact arrangement is acted on by a force directed outward in the radial direction with respect to the longitudinal axis.

5 Claims, 2 Drawing Sheets

POWER CIRCUIT-BREAKER

BACKGROUND OF THE INVENTION

1. Field of the Invention

The invention is based on a power circuitbreaker and in particular, a power circuit-breaker for quenching low-current arcs.

2. Discussion of Background

Power circuit-breakers are known which are filled with a gaseous insulating and quenching medium, preferably sulfur hexafluoride, and have at least one arcing chamber. As a rule, the arcing chamber is provided with a main current path and with a rated current path. The main current path has at least one fixed contact and one moving contact. The quenching chamber can be designed as a single-blown chamber or as a chamber provided with double blowing. Furthermore, the arcing chamber can be designed as a self-blown chamber in which the energy of the arc itself produces the blowing pressure required for quenching said arc, which blowing pressure is stored in a blowing volume until it is possible to blow the arc in a manner which promises success. A particularly rapid build up in pressure in the blowing volume is achieved if the arc is caused to rotate by one of the known measures.

In the case of a power circuit-breaker in which the energy of the arc itself produces the blowing pressure required for quenching said arc, it is possible for the pressure build up in the blowing volume to be too small when disconnecting small currents so that, in this case, successful blowing of the arc is not possible. It is necessary to ensure, with the aid of complex measures, for example by the installation of an additional blowing piston in the arcing chamber, that the arc is reliably quenched even in this switching case.

SUMMARY OF THE INVENTION

Accordingly, one object of the invention, is to provide a novel power circuit-breaker in the case of which simple means are used to ensure that even low-current arcs are reliably quenched.

The advantages achieved by the invention can be seen, essentially, in the fact that an additional arc when disconnecting comparatively small currents ensures that a sufficient quantity of the pressurized medium required for blowing the arc is produced. The volume as well as the dimensions of the arcing chamber can advantageously be kept small, since the means for the production of the additional arc occupy only a small amount of space.

The invention, its development and the advantages which can be achieved thereby are explained in more detail in the following text with reference to the drawing, which illustrates only one embodiment option.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Only those elements which are required for direct understanding of the invention are illustrated.

DESCRIPTION OF THE PREFERRED EMBODIMENTS

Figure 1:
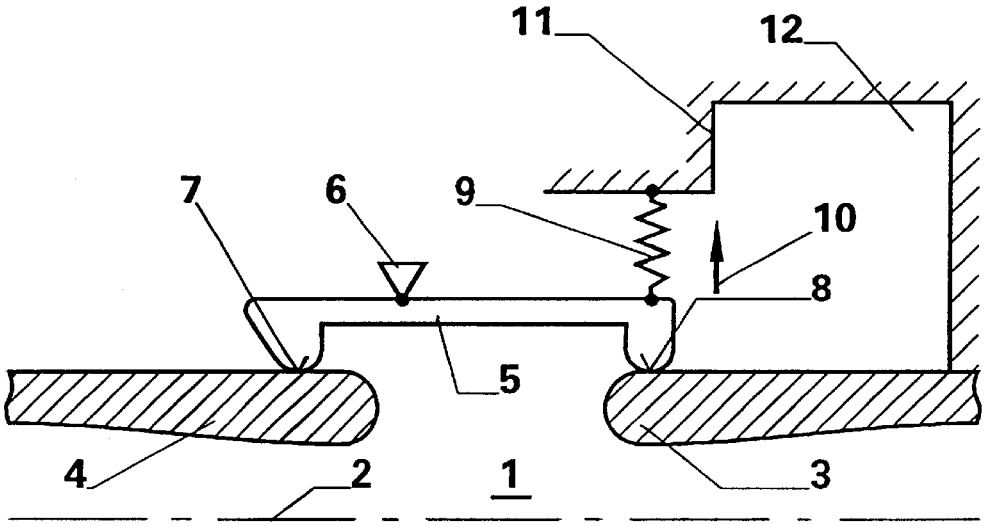
FIG. 1 shows a first, highly simplified partial section through the quenching zone of the arcing chamber of a power circuit-breaker according to the invention, in the connected state.

Referring now to the drawings, wherein like reference numerals designate identical or corresponding parts throughout the several views, FIG. 1 illustrates a first, highly simplified partial section through a quenching zone 1 of the arcing chamber of a power circuit-breaker according to the invention, in the connected state. In order to assist clarity, the other parts of the arcing chamber, in particular its housing and its drive as well, are not illustrated. This arcing chamber is filled with an insulating medium, for example with gaseous sulfur hexafluoride ($SF_6$). The arcing chamber has a longitudinal axis 2 around which a fixed contact arrangement 3 and, in the same way, a moving contact arrangement 4 are arranged symmetrically with respect to the center. The moving contact arrangement 4 is operated by a drive, which is not illustrated, in the axial direction.

In the connected state, as is illustrated in FIG. 1, the fixed contact arrangement 3 is electrically conductively connected to the moving contact arrangement 4 via a contact link 5. The contact link 5 is made of an electrically conductive metal and is designed in the form of a contact finger. It is possible to install this contact link 5 in a contact basket, and it can also comprise a plurality of parallel-arranged contact fingers. The contact link 5 is mounted in a holder 6, which is illustrated schematically, such that it can rotate. The holder 6 can be of sprung design, the contact link 5 being pressed at right angles toward the longitudinal axis 2 in order to achieve a sufficiently large contact force for the contact link 5. The contact link 5 has a contact point 7 which, in the connected state, rests on the moving contact arrangement 4. The contact link 5 has a further contact point 8 which, in the connected state, rests on the fixed contact arrangement 3. A tension spring 9 is fitted on that side of the contact link 5 which is opposite the contact point 8 and exerts a force on the contact link 5 whose direction is indicated by an arrow 10. The rotation point of the holder 6 is selected such that contact forces which are produced by electromagnetic forces press the contact point 8 of the contact link 5 more strongly onto the fixed contact arrangement 3 than is the case for the contact point 7, which presses onto the moving contact arrangement 4.

A schematically indicated wall 11 encloses a blowing volume 12 which is of annular design and whose inner boundary forms the outside of the fixed contact arrangement 3. The current path for the alternating current flowing through the enclosed arcing chamber leads, if the power circuit-breaker is designed for comparatively low rated currents, from the fixed contact arrangement 3 via contact point 8 into the contact link 5 and through it and the contact point 7 into the moving contact arrangement 4. If the power circuit-breaker, and thus the arcing chamber, is designed for comparatively large rated currents, then a separate rated current path which as a rule is arranged outside and concentrically with respect thereto, is provided parallel to the current path described above. The alternating current to be disconnected commutates from this rated current path to the current path described above, in a known manner, in order to initiate the disconnection process.

The structural design of the contact link 5, together with the contact points 7 and 8 will not be described in more detail here. Those parts which the ends of the arc touch can be provided with wear-resistant covers made of an electrically conductive material. Tungsten/copper is preferably used for these covers, but graphite can also be used.

Figure 2:
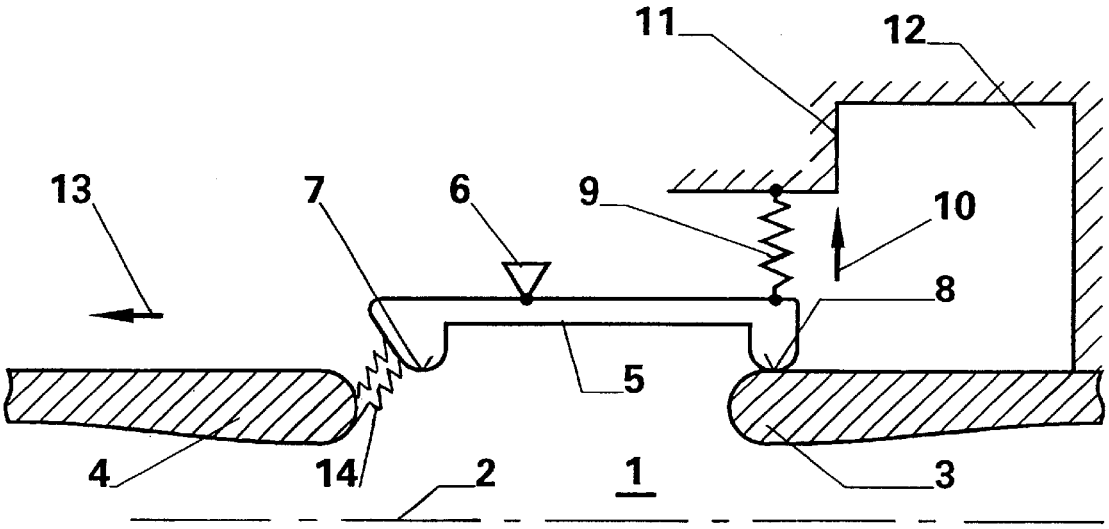
FIG. 2 shows a second, highly simplified partial section through the quenching zone of this arcing chamber during opening with a comparatively high-current arc.

FIG. 2 shows the quenching zone 1, which is illustrated in FIG. 1, of the arcing chamber in a first intermediate position shortly after the moving contact arrangement 4 has become detached from the contact link 5 during the movement in the direction of an arrow 13 and, in doing so, has struck an arc 14. It is intended to interrupt a comparatively large disconnection current in the case of this disconnection process. The electromagnetic forces produced by the disconnection current counteract the force exerted by the tension spring 9 on the contact link 5, so that the contact link 5 remains in the same position as in the connected state of the arcing chamber, and the contact point 8 remains in contact with the fixed contact arrangement 3. The arc energy of the arc 14 heats the gas in the quenching zone 1 strongly and thus produces a sufficiently high gas pressure. The pressurized gas flows away into the blowing volume 12, where it is stored until it becomes possible to blow the arc 14 in a manner which promises success.

Figure 3:
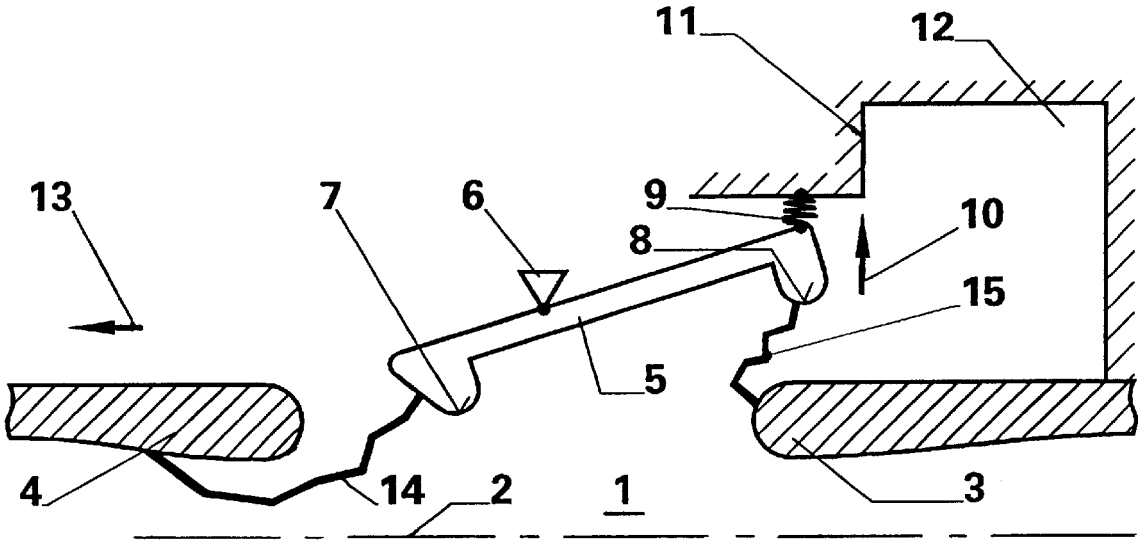
FIG. 3 shows a third, highly simplified partial section through the quenching zone of this arcing chamber during opening with a comparatively low-current arc.

FIG. 3 shows the quenching zone 1, which is illustrated in FIG. 1, of the arcing chamber in a further intermediate position shortly after the moving contact arrangement 4 has separated from the contact link 5 during the movement in the direction of an arrow 13 and, in doing so, has struck an arc 14. A comparatively low disconnection current is intended to be interrupted in the case of this disconnection process. The electromagnetic forces produced by the disconnection current admittedly counteract the force exerted by the tension spring 9 on the contact link 5 but they cannot compensate for this force in this switching case so that the contact link 5 carries out a tilting movement about the rotation point of the holder 6. The contact point 8 of the contact link 5 lifts off the fixed contact arrangement 3, as a result of the action of the tension spring 9, as soon as the moving contact arrangement 4 has separated from the contact point 7. This lifting off results in an auxiliary arc 15 additionally being struck between the contact point 8 of the contact link 5 and the fixed contact arrangement 3.

The arc energy of this low-current arc 14 is not sufficient to produce a sufficiently large amount of the pressurized gas for successful blowing. The arc energy of this additional auxiliary arc 15 heats the gas in its vicinity and thus produces an additional quantity of pressurized gas. The pressurized gas produced by the arc 14 now flows together with the pressurized gas additionally produced by the auxiliary arc 15 away into the blowing volume 12, where it is stored until it becomes possible to blow the arc 14 in a manner which promises success.

The force of the tension spring 9 is set such that it can move the contact link 5 only in the current range in which the production of a quantity of pressurized gas sufficient for blowing is no longer ensured by the arc 14 on its own. Accordingly, the auxiliary arc 15 occurs only when the production of pressurized gas by the arc 14 needs to be assisted in order to ensure successful current interruption in the end.

In the same way as the auxiliary arc 15, the arc 14 has a different intensity depending on the instantaneous value of the alternating current to be disconnected, so that the amount of pressure produced in the quenching zone 1 thereby is also of different intensity. When the arc current comes into the vicinity of a current zero crossing, then the gas pressure in the quenching zone 1 is less than in the blowing volume 12. This pressure gradient between the blowing volume 12 and the quenching zone 1 causes the compressed gas to flow out of the blowing volume 12 into the quenching zone 1. This gas flow cools the arc 14 and, if it is present, the auxiliary arc 15 as well and causes it or them to be quenched at a current zero crossing.

What is claimed as new and desired to be secured by Letters Patent of the United States is:

1. A power circuit-breaker comprising:

at least one cylindrically constructed arcing chamber which is filled with an insulating medium and has a quenching zone extending along a longitudinal axis, a fixed contact arrangement which is arranged in a course of a main current path, a moving contact arrangement having a blowing volume which stores an increased pressure of the insulating medium which occurs during a disconnection process, at least one contact link having a first side with a first contact point and a second side with a second contact point, said at least one contact link electrically conductively connects the fixed contact arrangement and the moving contact arrangement to one another in a connected position, wherein the at least one contact link is mounted in a holder such that said contact link can rotate, and wherein the first side of the at least one contact link which interacts with the fixed contact arrangement is acted on by a force directed outward in a radial direction with respect to the longitudinal axis.

2. The power circuit-breaker as claimed in claim 1, wherein a tension spring is provided for the force which acts radially outward.

3. The power circuit-breaker as claimed in claim 2, wherein the holder is at a shorter distance from the second contact point which interacts with the moving contact arrangement than from the first contact point.

4. The power circuit-breaker as claimed in claim 1, wherein the at least one contact link is arranged in a contact basket.

5. The power circuit-breaker as claimed in claim 1, wherein said moving contact arrangement can form an arc with said contact link when it becomes separated therefrom such that said first side of said contact link overcomes the force acting thereon and said fixed contact arrangement forms an auxiliary arc with said contact link when it becomes separated therefrom.

* * * * *